US012221783B1

(12) United States Patent
Milligan

(10) Patent No.: US 12,221,783 B1
(45) **Date of Patent: *Feb. 11, 2025**

(54) PERIMETER BARRIER FOR A BUILDING STRUCTURE

(71) Applicant: Strong Skirt LLC, Tulsa, OK (US)

(72) Inventor: Christopher Milligan, Georgetown, TX (US)

(73) Assignee: STRONG SKIRT LLC, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/625,516

(22) Filed: Apr. 3, 2024

Related U.S. Application Data

(63) Continuation of application No. 18/377,480, filed on Oct. 6, 2023, now Pat. No. 12,012,747.

(51) Int. Cl.
*E04B 1/343* (2006.01)

(52) U.S. Cl.
CPC ..... *E04B 1/34342* (2013.01)

(58) Field of Classification Search
CPC ..... E04B 1/34342; E04B 1/34352
USPC ..... 52/169.12
See application file for complete search history.

(56) References Cited

U.S. PATENT DOCUMENTS

| | | | | |
|---|---|---|---|---|
| 2,618,493 A | | 11/1952 | Fransen | |
| 2,961,255 A | | 11/1960 | Trott | |
| 3,106,411 A | | 10/1963 | Holmes | |
| 3,113,357 A | | 12/1963 | Reukauf | |
| 3,562,983 A | | 2/1971 | Rector | |
| 3,571,998 A | * | 3/1971 | Iacona | E04B 1/34342 52/798.1 |
| 3,636,661 A | | 1/1972 | Strawsine | |
| 3,694,979 A | | 10/1972 | Vadnie | |
| 3,710,525 A | | 1/1973 | Lopes | |
| 3,712,005 A | * | 1/1973 | Eschbach | E04B 2/78 296/191 |
| 3,722,156 A | | 3/1973 | Bryant | |
| 3,753,323 A | | 8/1973 | Nesbitt | |
| 3,775,917 A | | 12/1973 | Struben | |
| 3,803,781 A | | 4/1974 | Struben | |
| 3,827,201 A | | 8/1974 | Struben | |
| 3,832,813 A | | 9/1974 | Hindman | |

(Continued)

FOREIGN PATENT DOCUMENTS

| | | |
|---|---|---|
| JP | H10140929 A | 11/1996 |
| JP | 2001146850 A | 5/2001 |

OTHER PUBLICATIONS

Shane Davis, Preliminary Patentability Search dated Sep. 11, 2023 (Sep. 11, 2023), 2 pages, Covalent Patent Research.
Product Specification Guide, Strong Skirt, LLC. 2017, 20 pages.

*Primary Examiner* — James M Ference
(74) *Attorney, Agent, or Firm* — Dickinson Wright PLLC

(57) ABSTRACT

A perimeter barrier for a building structure includes a panel and a j-track coupled to a bottom of the panel. A top track and a z-vent are coupled to the building structure such that the top track and z-vent secure an upper portion of the panel. A top h-track is coupled to the panel and top track, and a bottom h-track is mounted to the panel and the j-track. In addition, a door is installed in the top h-track and the bottom h-track to provide access through the perimeter barrier to a space beneath the building structure. In addition, a kit for such types of components is disclosed.

15 Claims, 15 Drawing Sheets

(56) References Cited

U.S. PATENT DOCUMENTS

| | | | | | |
|---|---|---|---|---|---|
| 3,834,109 | A | | 9/1974 | Iacona | |
| 3,866,381 | A | * | 2/1975 | Eschbach | B62D 33/046 52/262 |
| RE28,987 | E | | 10/1976 | Tacona | |
| 4,004,373 | A | * | 1/1977 | Eschbach | B62D 33/046 49/501 |
| 4,010,963 | A | | 3/1977 | Prentice | |
| 4,043,088 | A | | 8/1977 | Payton | |
| 4,107,888 | A | | 8/1978 | Krueger | |
| 4,112,638 | A | | 9/1978 | Hanson | |
| 4,159,844 | A | | 7/1979 | Weiner | |
| 4,214,412 | A | | 7/1980 | Barylski | |
| 4,352,261 | A | | 10/1982 | Wargo | |
| 4,361,994 | A | * | 12/1982 | Carver | E06B 3/5821 D25/121 |
| 4,400,919 | A | | 8/1983 | Szabo | |
| 4,549,378 | A | | 10/1985 | Ayers | |
| 4,760,872 | A | | 8/1988 | Hale, Jr. | |
| 4,805,361 | A | | 2/1989 | Mason et al. | |
| D355,494 | S | | 2/1995 | Fenske | |
| D402,063 | S | | 12/1998 | Dickey | |
| 5,907,933 | A | | 6/1999 | Stanfill | |
| 6,189,264 | B1 | | 2/2001 | DiVeroli | |
| 7,150,126 | B2 | | 12/2006 | Rivera | |
| 7,681,362 | B1 | | 3/2010 | Averitt | |
| 7,685,781 | B1 | | 3/2010 | Hatch | |
| 8,388,043 | B2 | | 3/2013 | Lahnala | |
| 8,756,878 | B1 | | 6/2014 | Powell | |
| 10,844,592 | B2 | | 9/2020 | Jimenez | |
| 12,012,747 | B1 | * | 6/2024 | Milligan | E04B 1/34342 |
| 2005/0098060 | A1 | | 5/2005 | Bigda | |
| 2007/0028529 | A1 | | 2/2007 | Carter | |

* cited by examiner

PERIMETER BARRIER FOR A BUILDING STRUCTURE

CROSS-REFERENCE TO RELATED APPLICATION

This application is a continuation of and claims priority to and the benefit of U.S. application Ser. No. 18/377,480, filed Oct. 6, 2023, which is incorporated herein by reference in its entirety.

BACKGROUND

Field of the Disclosure

The present disclosure relates in general to mobile homes and, in particular, to a perimeter barrier around a bottom of a building structure.

Description of the Prior Art

Mobile homes typically are elevated on a frame or foundation by a few feet above the underlying surface or earth. This construction leaves the underside of the home, and the surface beneath it, exposed to the elements. Perimeter barriers can be installed around the bottom of the home to conceal and protect the space beneath it. Conventional perimeter barriers for mobile homes also are known as "skirting" or skirting systems. Although some conventional solutions are workable, improvements in skirting systems for buildings continue to be of interest.

SUMMARY

Embodiments of a system, method and apparatus for a perimeter barrier for a building structure are disclosed. For example, a perimeter barrier for a building structure can include a panel and a j-track coupled to a bottom of the panel. A top track and a z-vent can be coupled to the building structure such that the top track and z-vent secure an upper portion of the panel. A top h-track can be coupled to the panel and top track, and a bottom h-track can be mounted to the panel and the j-track. In addition, a door can be installed in the top h-track and the bottom h-track to provide access through the perimeter barrier to a space beneath the building structure. In addition, embodiments of a kit are disclosed.

BRIEF DESCRIPTION OF THE DRAWINGS

Before one or more embodiments are described in detail, one skilled in the art will appreciate that they are not limited in its application to the details of construction, the arrangements of components, and the arrangement of steps set forth in the following detailed description or illustrated in the drawings and descriptions. Rather, they are capable of other embodiments and of being practiced or being carried out in various ways. Also, it is to be understood that the phraseology and terminology used herein is for the purpose of description and should not be regarded as limiting.

DETAILED DESCRIPTION

Referring to FIGS. 1-18, the following descriptions of various implementations of the present teachings have been presented for purposes of illustration and description. It is not exhaustive and does not limit the present teachings to the precise form disclosed. Modifications and variations are possible in light of the above teachings or may be acquired from practicing the present teachings.

Figure 1:
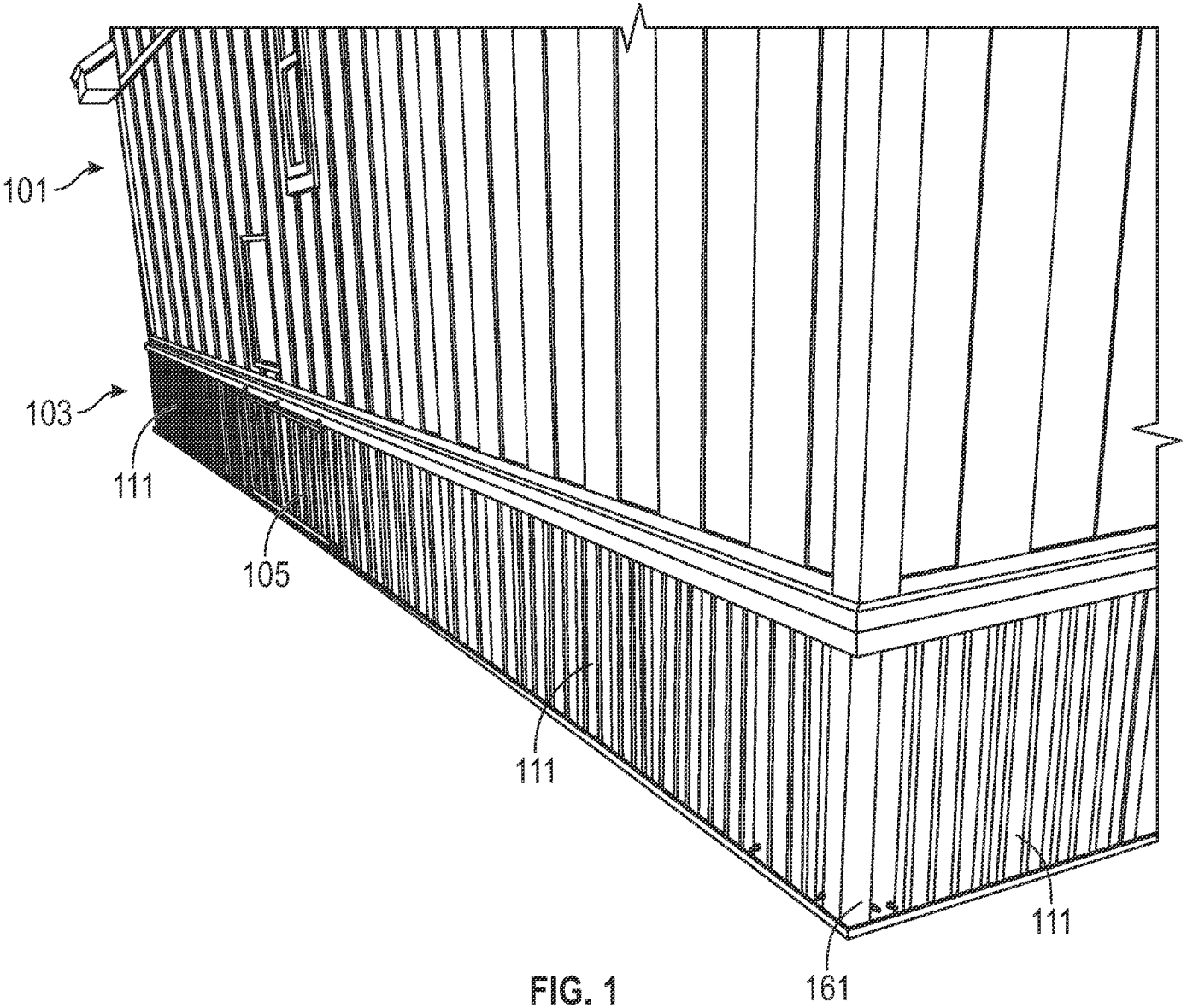
FIG. 1 is an isometric view of an embodiment of a skirting mounted to a home.
Figure 2:
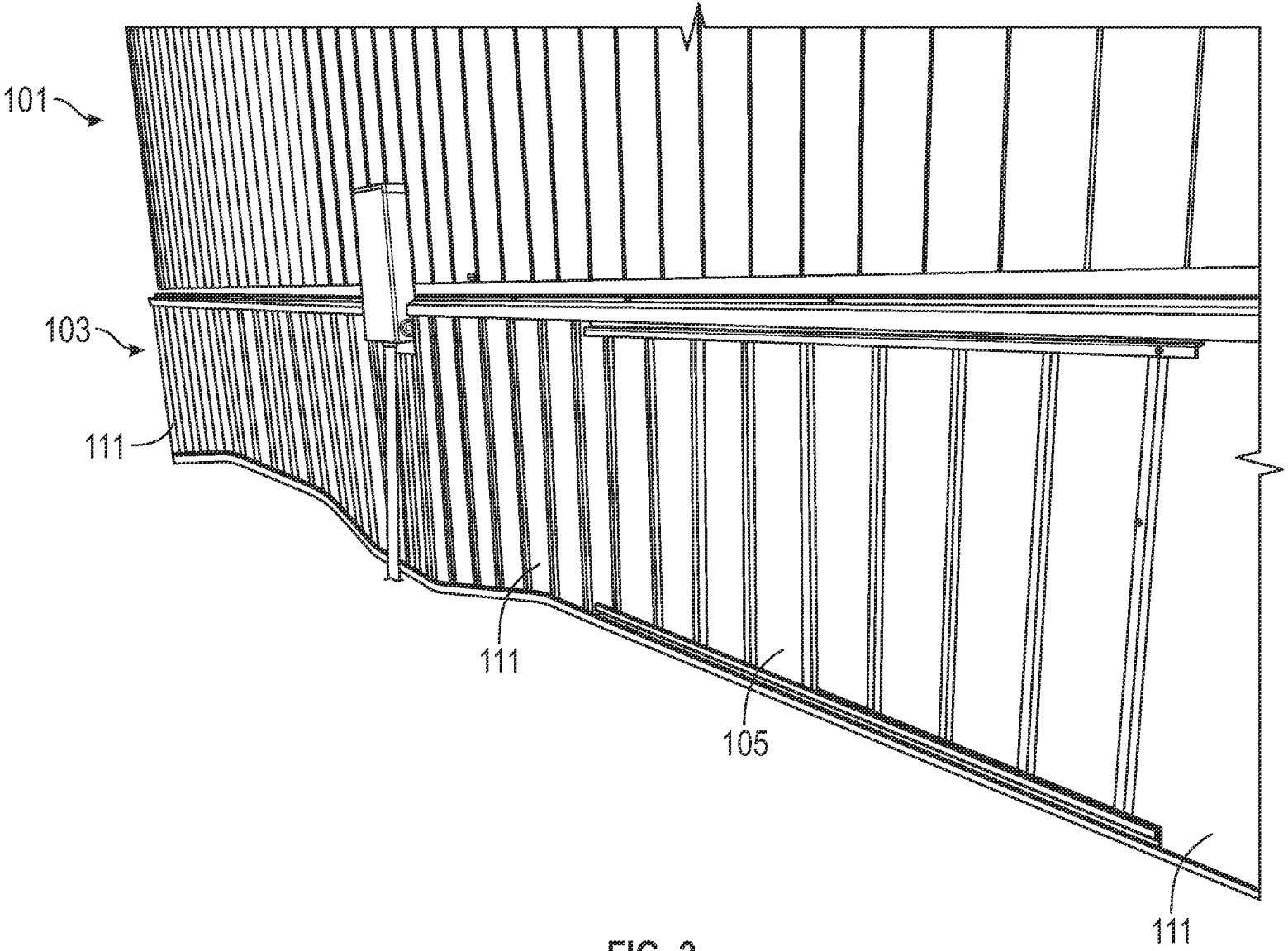
FIG. 2 is another isometric view of the skirting and home of FIG. 1.
Figure 3:
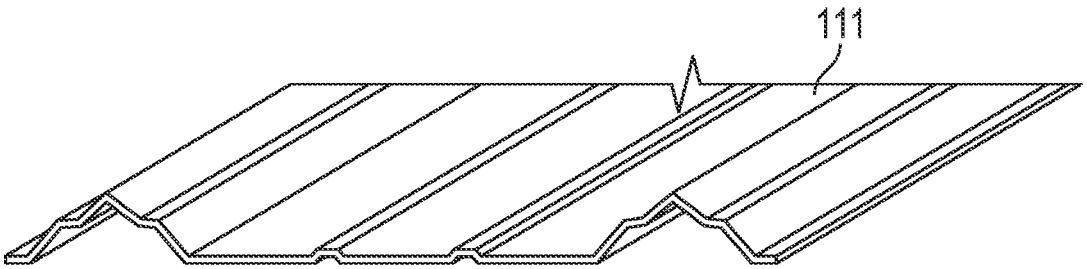
FIG. 3 is an isometric view of an embodiment of a panel.
Figure 4:
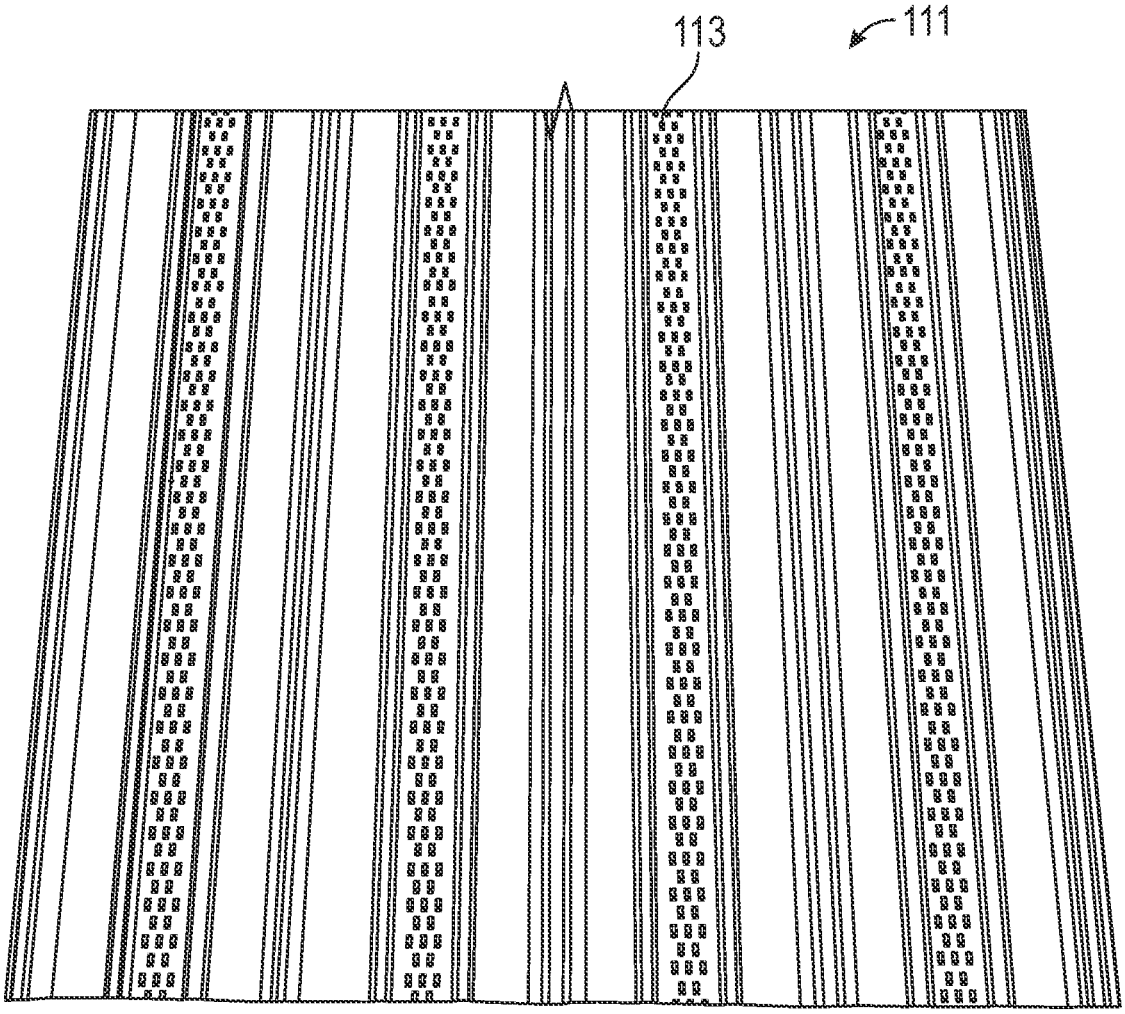
FIG. 4 is an isometric view of another embodiment of a panel.
Figure 5:
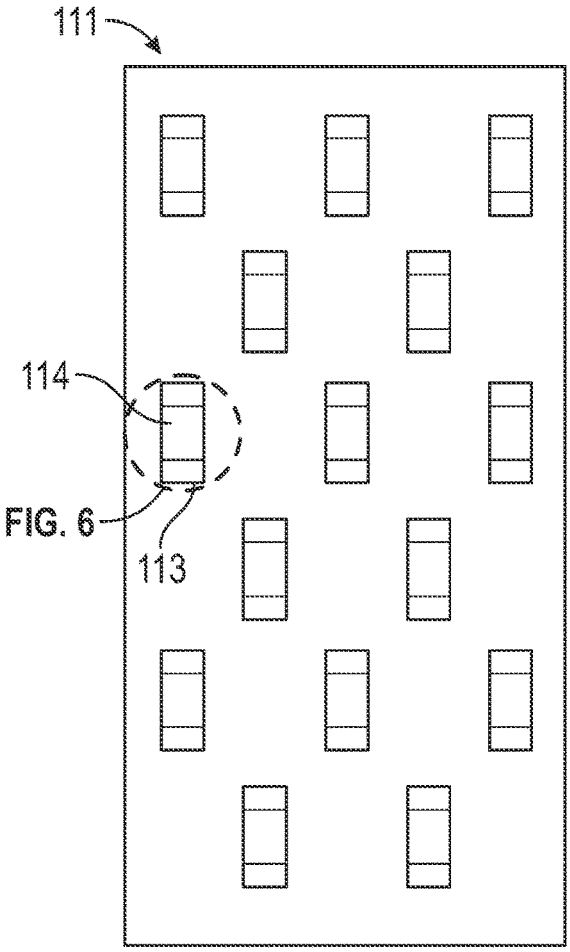
FIG. 5 is an enlarged front view of an embodiment of a portion of a panel.

Embodiments of a system, method and apparatus for a perimeter barrier for a building structure are disclosed. For example, FIGS. 1 and 2 depict a mobile home or home 101 having skirting 103. Embodiments of the skirting 103 may comprise a variety of components that are assembled together and to the home 101 with fasteners, such as screws. The skirting 103 can extend partially or completely around the bottom perimeter of the home 101 down to the underlying ground to form a barrier. Access through the skirting 103 to the space beneath the home 101 may be provided via a slidable door 105 that is movable in tracks, as will be described below.

Figure 6:
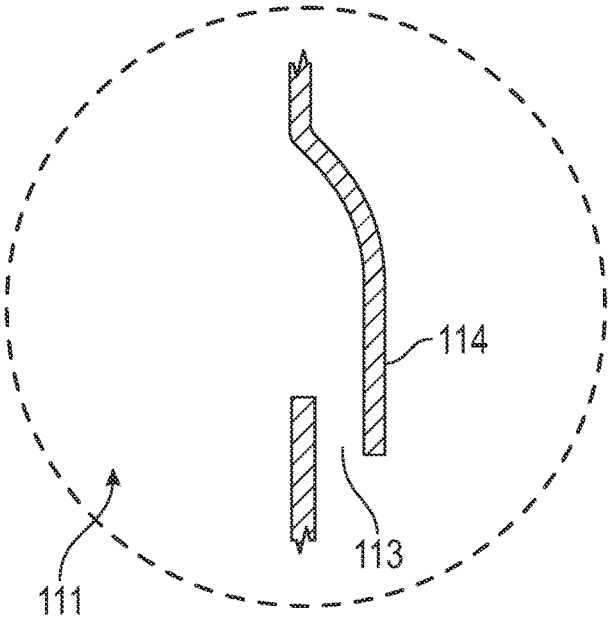
FIG. 6 is an enlarged sectional side view of a portion of the panel of FIG. 5.

In some versions, the primary component of the skirting 103 is a panel 111. Features of the panels 111 are shown in FIGS. 3-6. The panels 111 can be numerous and comprise most of the structure of the skirting 103. The panels 111 can be thin and rectangular in shape, and comprise a metal, such as aluminum, or a polymer like vinyl. The panels 111 can be corrugated for strength and rigidity, and also can be ventilated or perforated with apertures 113. In FIG. 6, note how the panel 111 can be partially punched, such that the punched portion 114 partially or completely cover the aperture 113 to provide enhanced weather protection. When formed from metal, the panels 111 also can be fire-proof as well as weed trimmer-proof.

Figure 7:
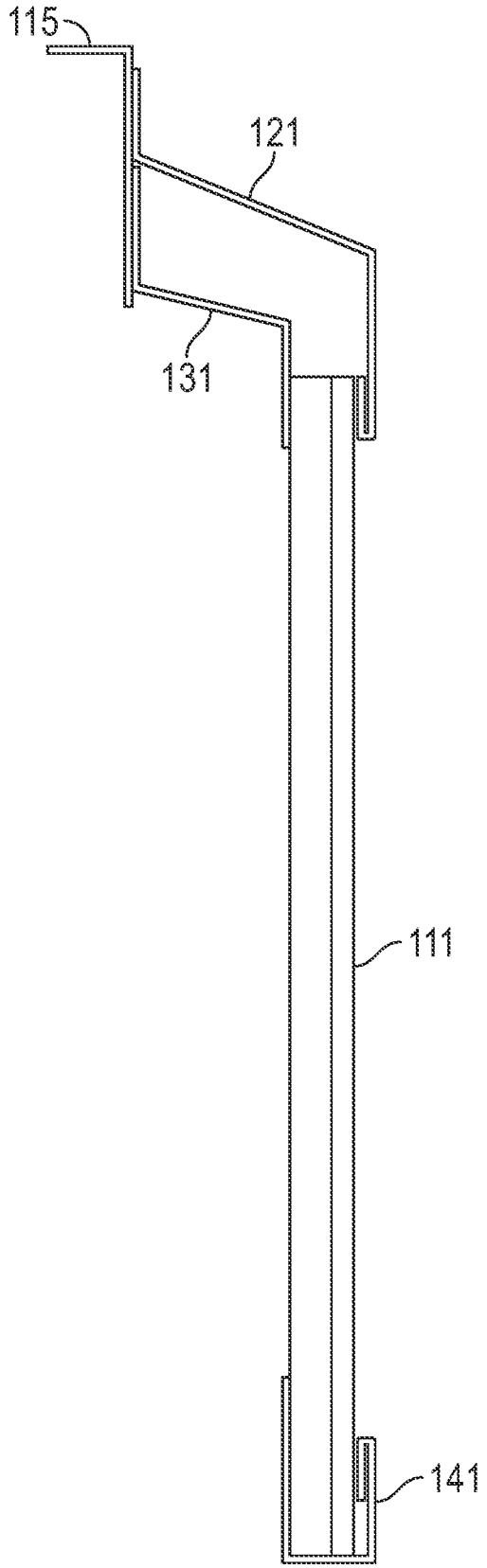
FIG. 7 is a sectional side view of an embodiment of a skirting.
Figure 8:
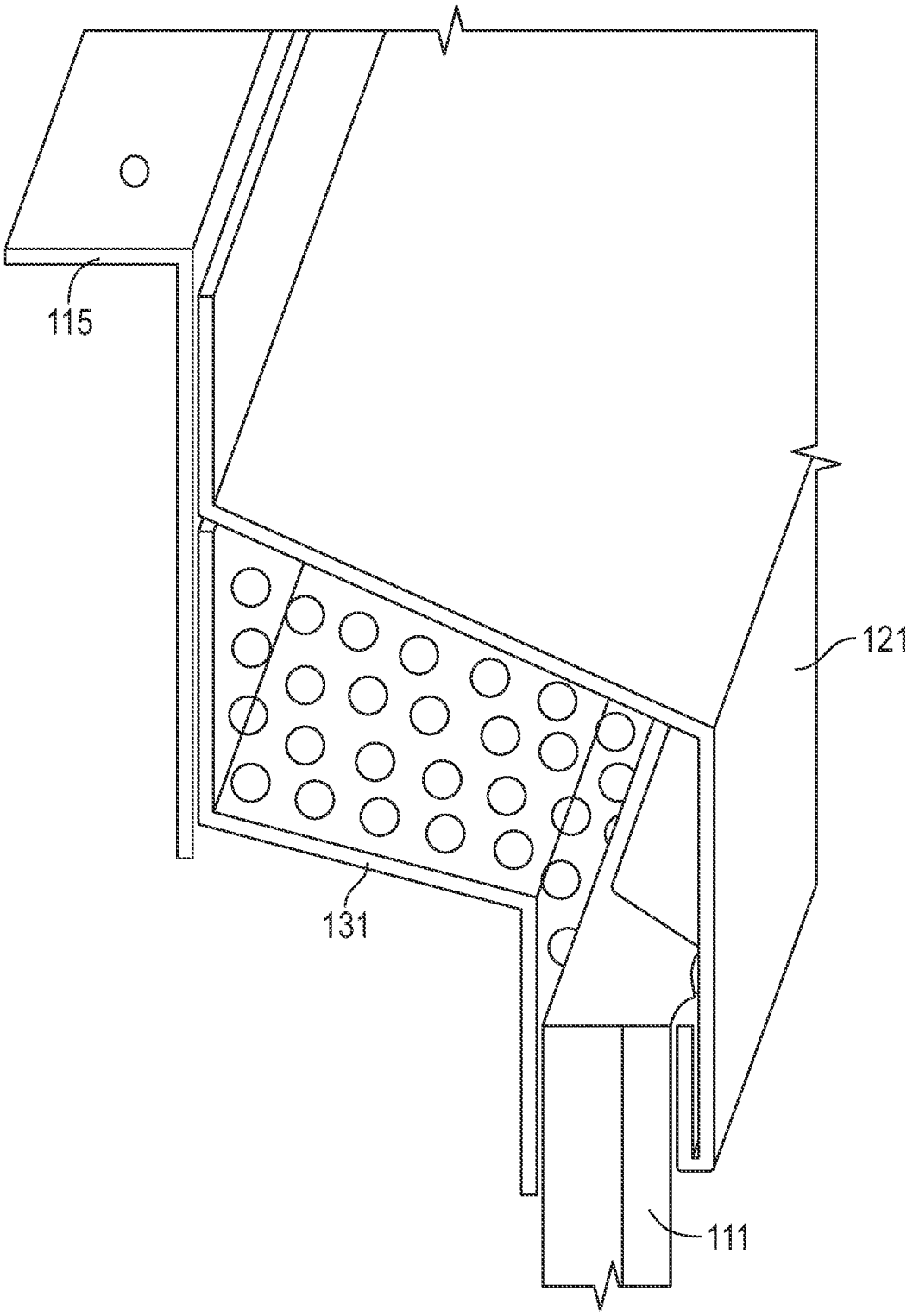
FIG. 8 is an enlarged isometric view of an upper portion of the skirting of FIG. 7.
Figure 9:
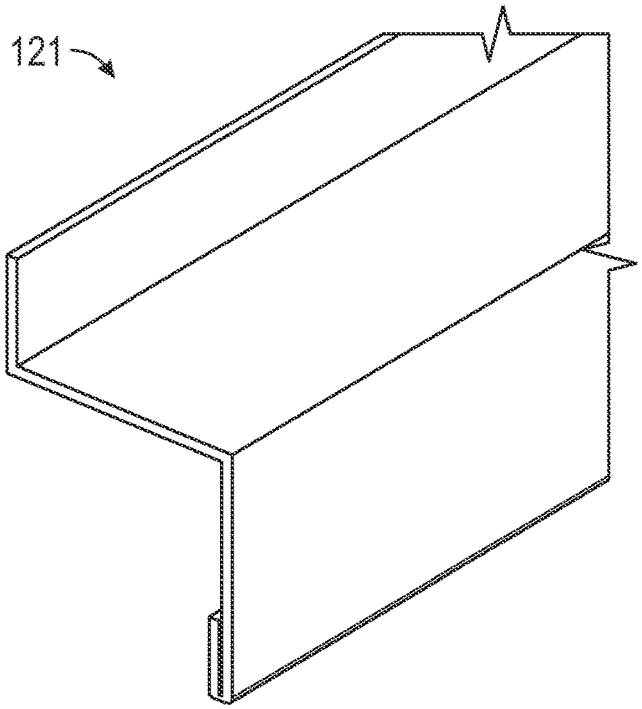
FIGS. 9-11 are isometric view of embodiments of a top track, z-vent and j-track, respectively.
Figure 10:
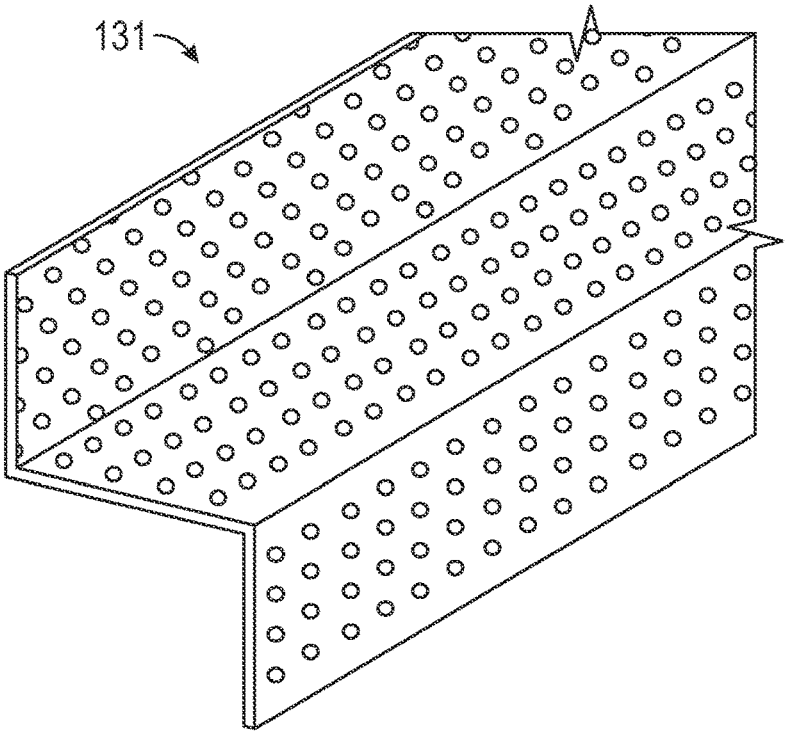
Figure 11:
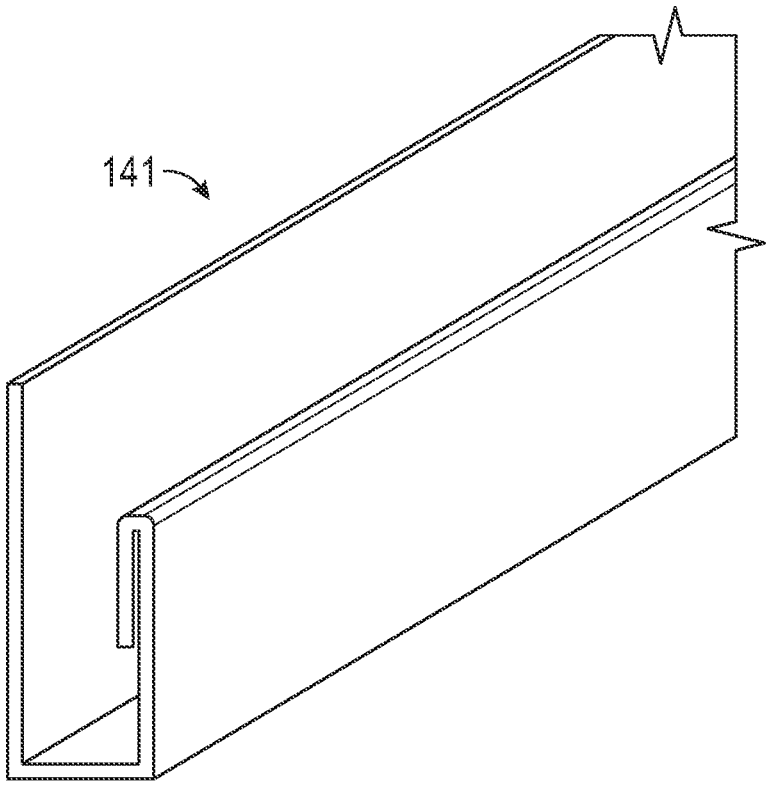

As shown in FIGS. 7 and 8, embodiments of each panel 111 can be installed in the skirting 103 with other components. For example, upper edges of the panel 111 can be secured to the home 101 with an optional bracket 115 (when needed) via a top track 121 (also shown in FIG. 9) and a z-vent 131. The top track 121 is either directly secured to the home 101 or to the optional bracket 115, as is the z-vent 131 (also shown in FIG. 10), which is known as an expansion joint that can be ventilated. The panel 111 can be secured to the z-vent 131 with fasteners, such as screws. The lower edges of the panel 111 can be mounted in and secured in a j-track 141 (see FIG. 11). Each of these components can be made to any desired dimensions, such as length, width, height and thickness of material.

Figure 12:
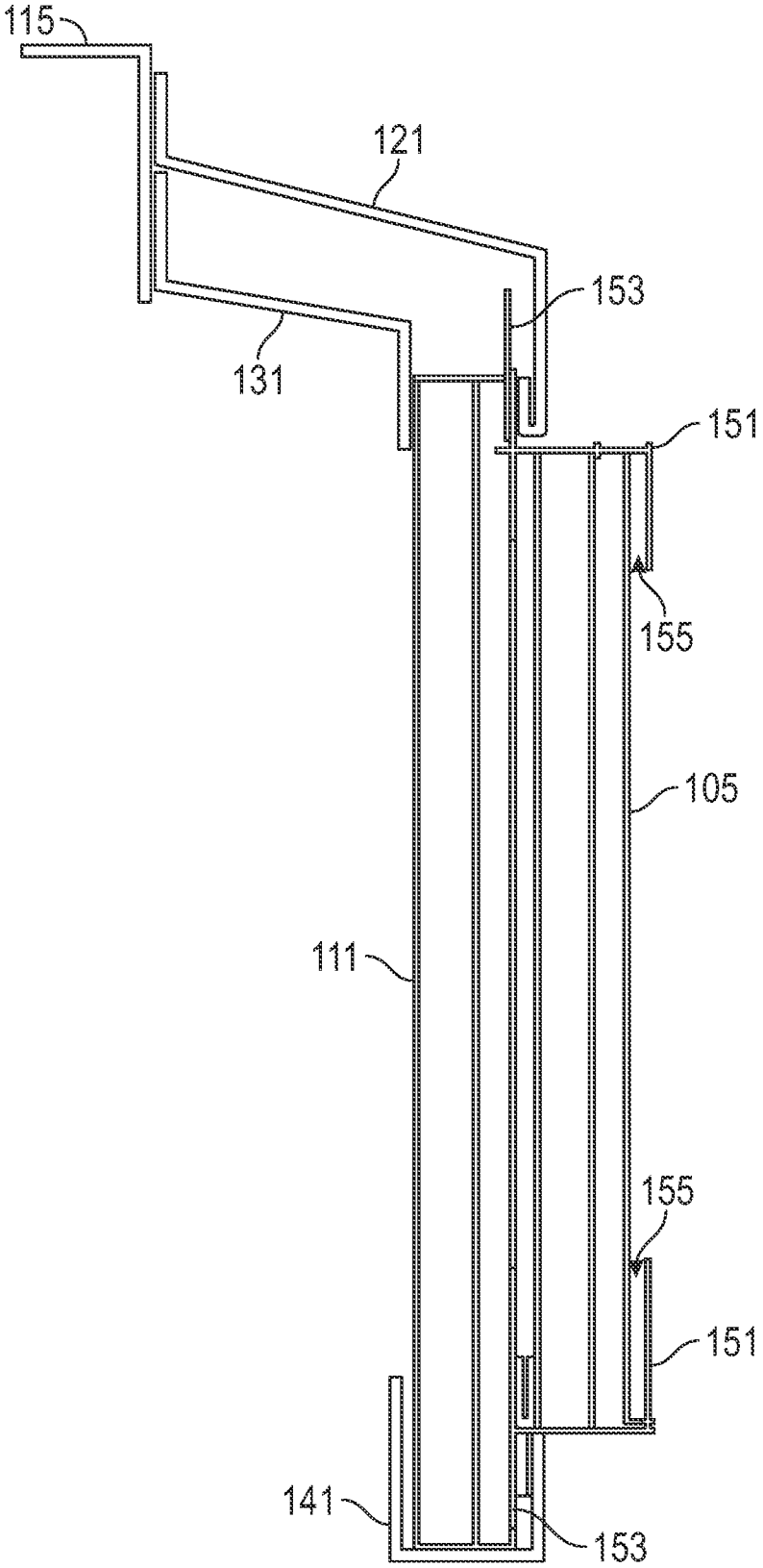
FIG. 12 is a sectional side view of another embodiment of a skirting.
Figure 13:
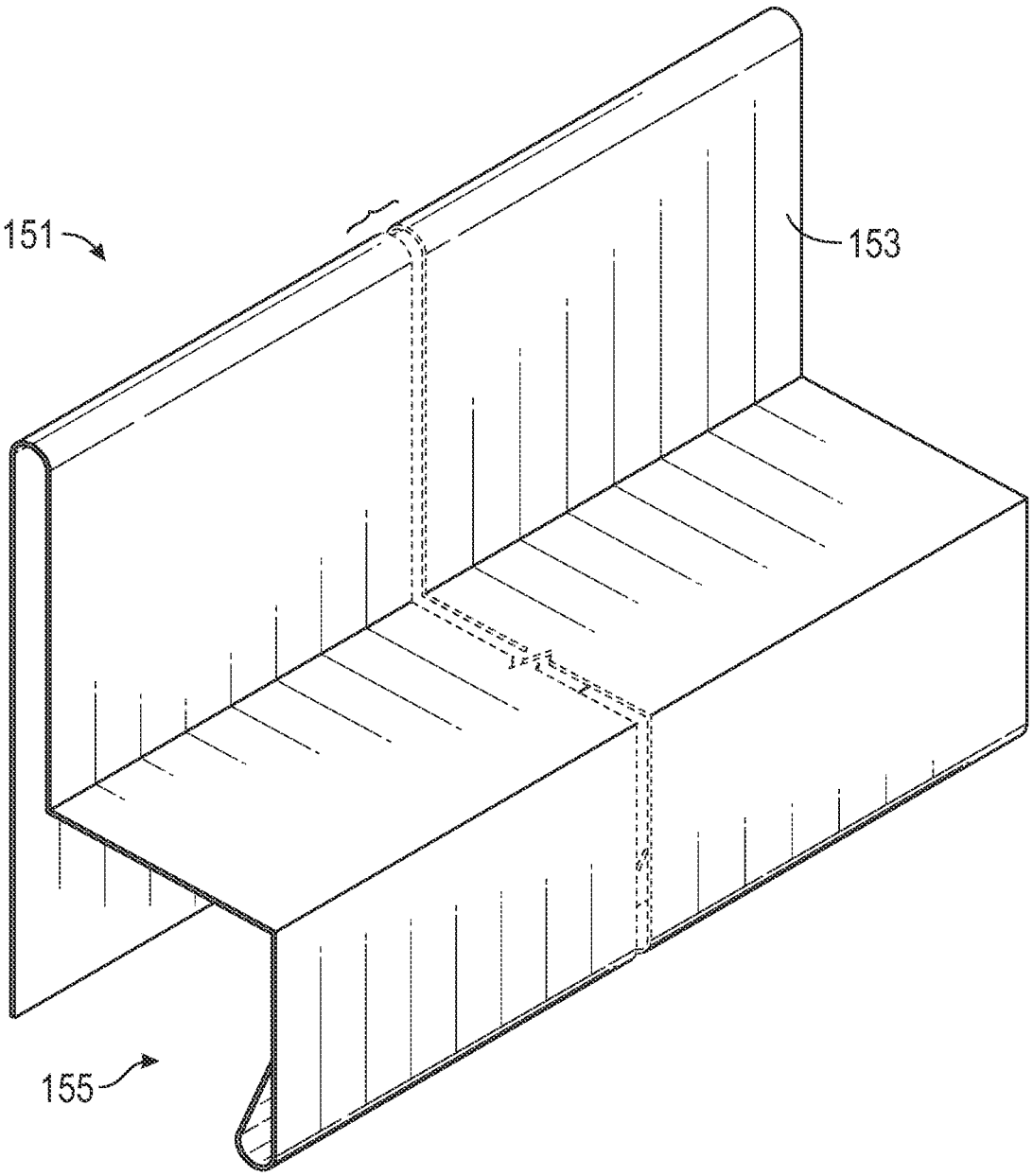
FIG. 13 is an isometric view of an embodiment of an h-track.

As previously discussed in FIGS. 1 and 2, the skirting 103 can be provided with a door 105. In some embodiments, the door 105 can be mounted in the system as shown in FIG. 12. In addition to the previously described components, an h-track 151 (also shown in FIG. 13) can be mounted at both the top and the bottom of the system. For example, one h-track 151 can be located at the top of the system by securing its flange 153 between a top of a panel 111 and a bottom of a top track 121. Another h-track 151 can be inverted and located at the bottom of the system by securing its flange 153 between the bottom of the panel 111 and the j-track 141. The two h-tracks 151 have slots 155 that can extend toward each other to define a narrow rectangular space, for example, in which the door 105 can be slidably mounted (e.g., to the left or to the right) to provide access through the skirting 103.

Alternatively, the upper h-track 151 may be provided with a deeper slot 155 that the bottom h-track 151. In this version, the deeper slot 155 enables the door 105 to be lifted vertically into the deeper slot 155 (rather than sliding left or right), such that the bottom of the door 105 may be removed from the j-track 141 toward the user, and then removed completely from the assembly.

Figure 14:
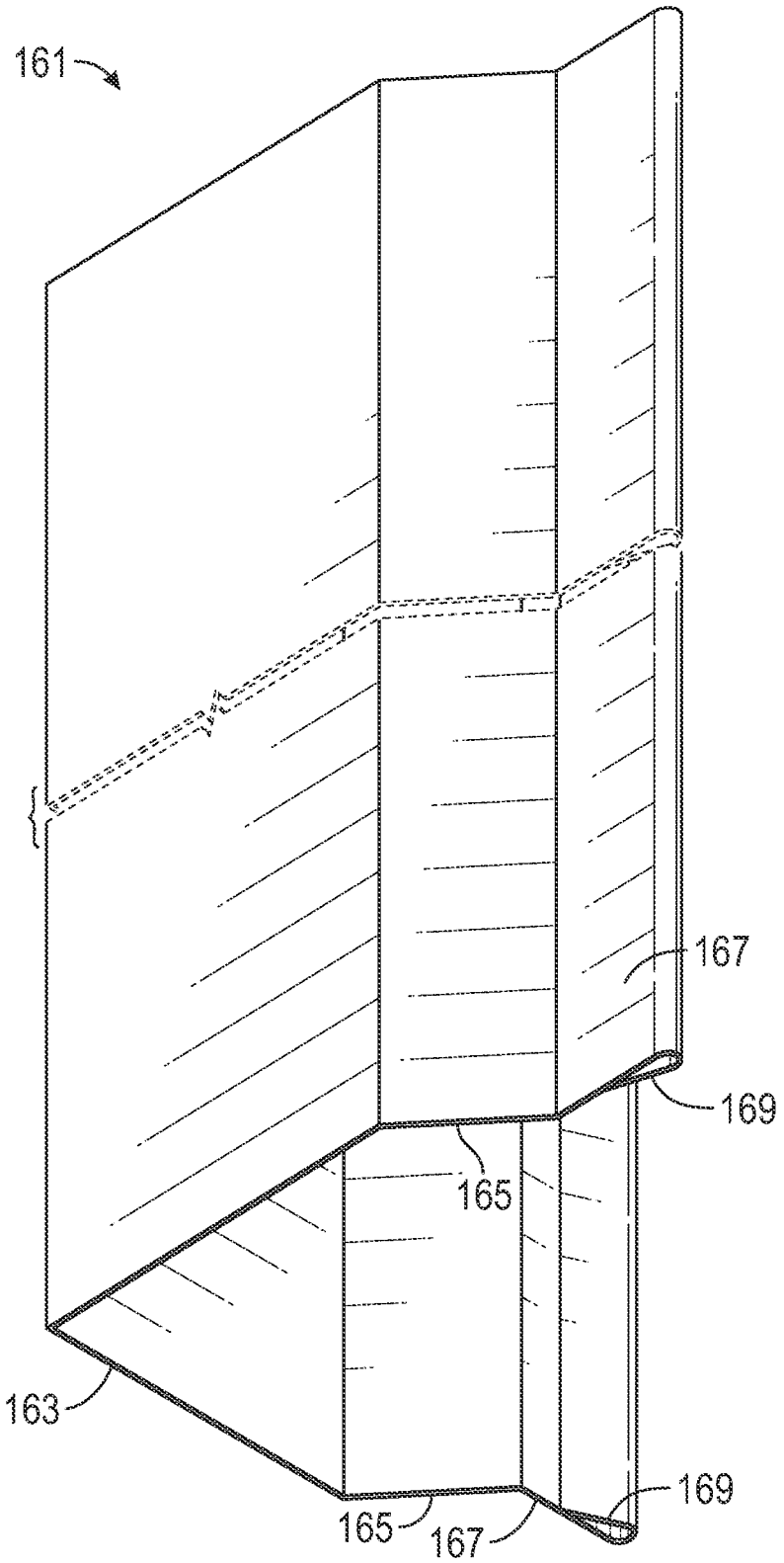
FIG. 14 is an isometric view of an embodiment of a corner.
Figure 15:
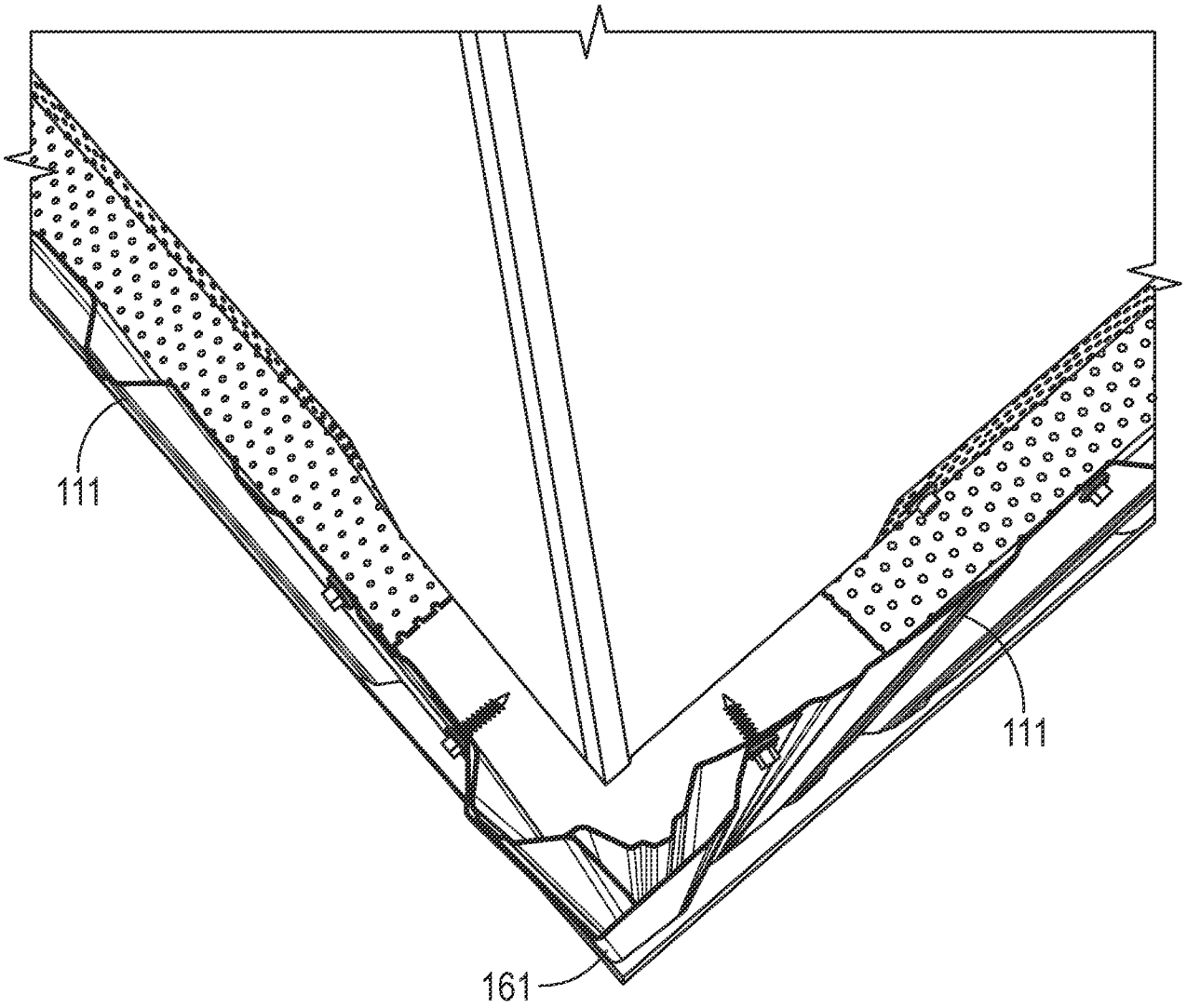
FIG. 15 is a top view of an embodiment of a corner installed on a home.

As shown in FIGS. 1, 14 and 15, embodiments of the skirting 103 also may comprise corners 161 at each corner intersection of the skirting 103. Each corner 161 may comprise a perpendicular section 163 from each side of which extends a wall 165 at a 135 degree angle with respect to the perpendicular section 163, for example. In some versions, a mounting flange 167 may extend from each wall 165 and be oriented at a 135 angle with respect to the respective wall 165. Thus, the mounting flanges 167 can be parallel to the respective sides of the perpendicular section 163. Each mounting flange 167 can comprise a rounded edge 169, which also is known as a hem, to prevent scratching of panels 111.

Figure 16:
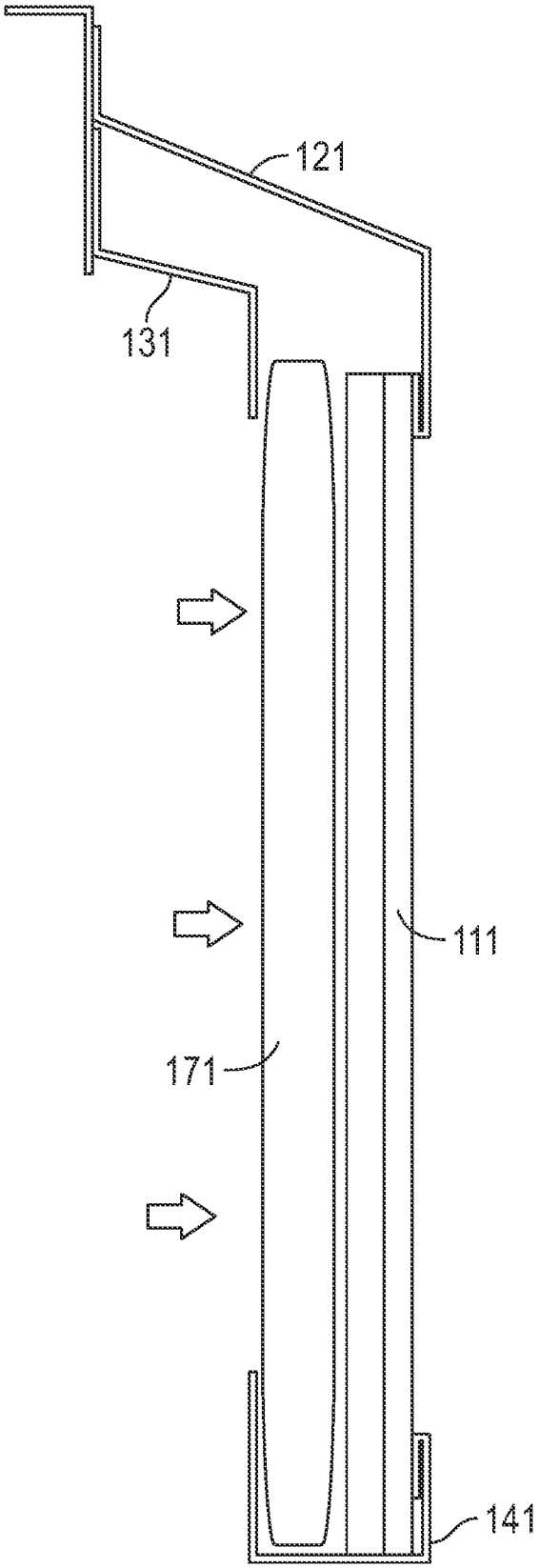
FIG. 16 is a sectional side view of still another embodiment of a skirting.
Figure 17:
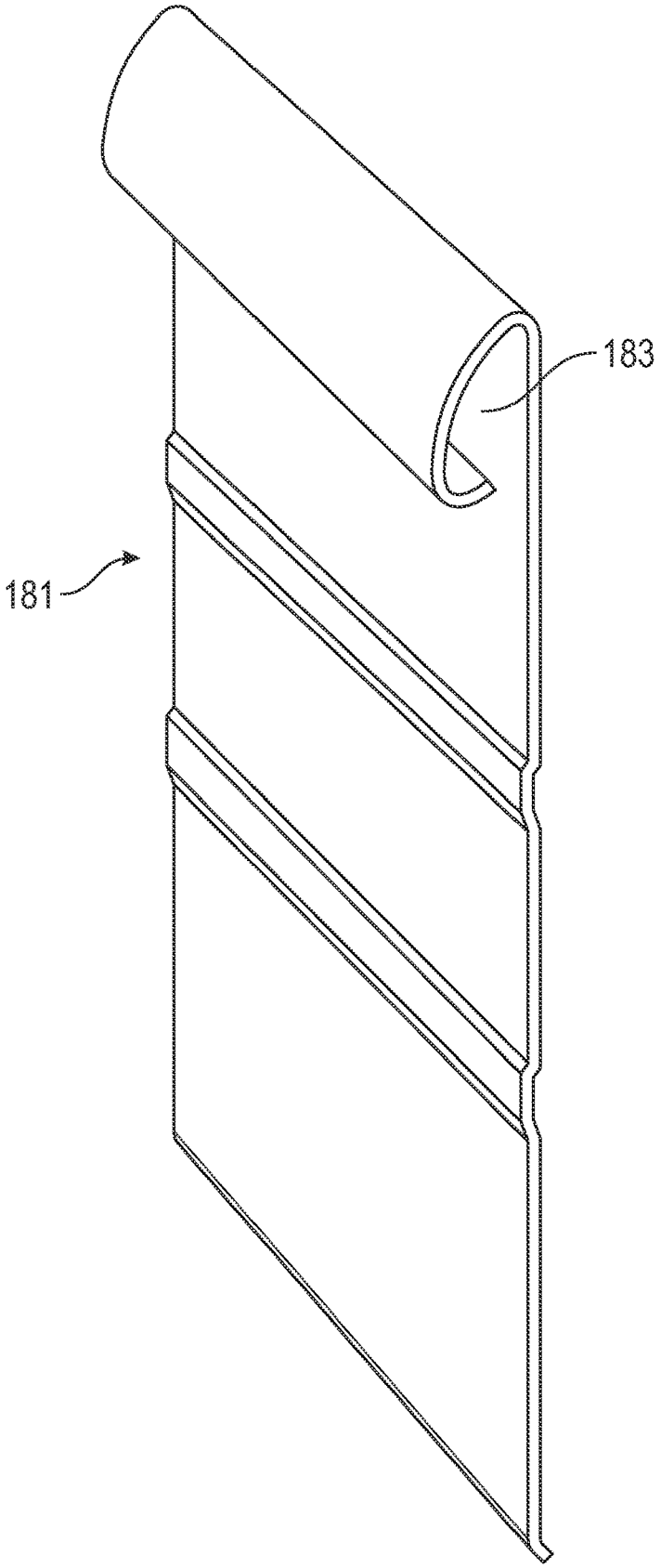
FIG. 17 is an isometric view of an embodiment of a top trim back for a kit.
Figure 18:
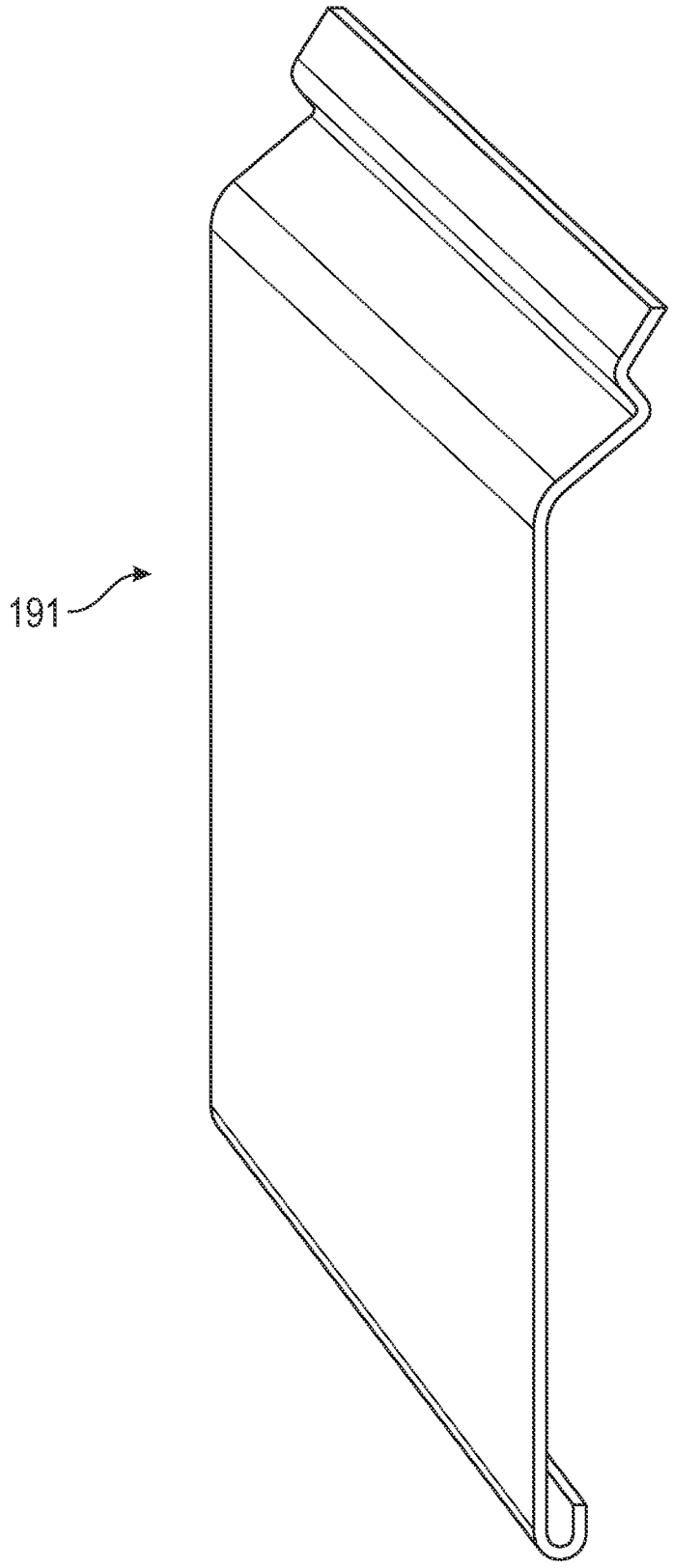
FIG. 18 is an isometric view of an embodiment of a top trim front for a kit.

FIG. 16 depicts an embodiment of the skirting 103 with an insulation panel 171. In this version, the insulation panel 171 can be installed behind the panel 111 (on an interior of the skirting 103) between the top track 121 and z-vent 131 with fasteners at the top of the assembly, and in the j-track 141 at the bottom of the assembly, optionally with fasteners. The insulation panel 171 can be formed from foam board or other materials.

In another embodiment, the skirting 103 can be sold as a "kit" of components that, when assembled together, can form a portion of the skirting 103. A consumer may then purchase as many "kits" as are needed to complete their particular length of skirting 103 for their home 101. For example, each of the following components may be provided in, e.g., twelve-foot lengths: a ventilated panel 111, a top trim back 181 (FIG. 17), a top trim front 191 (FIG. 18) and a j-track 141. In these versions, some of the other components previously described are not used in the system. Rather, an upper end of the top trim back 181 is fastened to the home 101, a bottom of the panel 111 is placed in the j-track 141, and an upper portion of the top trim front 191 is snapped into place in an upper slot 183 on the front face of the top trim back 181 to secure the upper end of the panel 111 in place therebetween.

Other embodiments can include one or more of the following items.

1. A perimeter barrier for a building structure, the perimeter barrier comprising:
a panel;
a j-track coupled to a bottom of the panel;
a top track and z-vent coupled to the building structure such that the top track and z-vent secure an upper portion of the panel;
a top h-track coupled to the panel and top track;
a bottom h-track mounted to the panel and the j-track; and
a door installed in the top h-track and the bottom h-track to provide access through the perimeter barrier to a space beneath the building structure.
2. The perimeter barrier wherein the panel comprises metal and has apertures for ventilation.
3. The perimeter barrier wherein the apertures are partially punched, such that punched portions of the panels cover the apertures.
4. The perimeter barrier wherein the bottom h-track is inverted relative to the top h-track.
5. The perimeter barrier wherein the top h-track has a flange that is located between a top of the panel and a bottom of the top track.
6. The perimeter barrier wherein the bottom h-track has a flange that is located between a bottom of the panel and the j-track.
7. The perimeter barrier wherein each of the top and bottom h-tracks have slots that extend toward each other to define a space in which the door is located.
8. The perimeter barrier further comprising corners at each corner intersection of the perimeter barrier.
9. The perimeter barrier wherein each corner comprises a perpendicular section, a wall extends from each side of the perpendicular section, a mounting flange extends from each wall, such that the mounting flanges are parallel to respective sides of the perpendicular section.
10. The perimeter barrier wherein each mounting flange comprises a rounded edge.
11. The perimeter barrier further comprising an insulation panel.
12. The perimeter barrier wherein the insulation panel is installed behind an interior of the panel between the top track and z-vent, and in the j-track, and the insulation panel comprises foam board.
13. The perimeter barrier wherein the insulation panel is fastened between the panel and the j-track at a bottom thereof, and the insulation panel is fastened to the panel and the z-vent at top thereof.
14. The perimeter barrier further comprising a bracket mounted to the building structure and to the top track and the z-vent.
15. The perimeter barrier wherein the door is slidably mounted in the j-track to move left or right relative to the j-track.
16. The perimeter barrier wherein the door can be vertically lifted into a slot in the upper h-track, and a bottom of the door can be removed from the j-track to remove an entirely of the door from the perimeter barrier, such that the door is not slidably mounted in the j-track to move left or right relative to the j-track.
17. A kit for a perimeter barrier for a home, the kit comprising:
a ventilated panel;
a top trim back comprises an upper end configured to be mounted to the home and, and the top trim back comprises an upper slot on a front face thereof;

a top trim front comprises an upper portion configured to be snapped into the upper slot of the top trim back to secure an upper portion of the ventilated panel therebetween;

a j-track configured to receive a bottom of the ventilated panel; and the ventilated panel, top trim back, top trim front and j-track are equal in length and comprise metal.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112 (f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A perimeter barrier for a building structure, the perimeter barrier comprising:

a panel;

a j-track coupled to a bottom of the panel;

a top track and a z-vent coupled to the building structure such that the top track and the z-vent secure an upper portion of the panel;

a top h-track coupled to the panel and the top track;

a bottom h-track mounted to the panel and the j-track; and a door installed in the top h-track and the bottom h-track to provide access through the perimeter barrier to a space beneath the building structure, and the door is configured to be vertically lifted into the top h-track, and a bottom of the door can be removed from the bottom h-track to remove an entirety of the door from the perimeter barrier.

2. The perimeter barrier of claim 1, wherein the panel comprises metal and has apertures for ventilation.

3. The perimeter barrier of claim 2, wherein the apertures are partially punched, such that punched portions of the panels cover the apertures.

4. The perimeter barrier of claim 1, wherein the top and bottom h-tracks are identical to each other, and the bottom h-track is inverted relative to the top h-track.

5. The perimeter barrier of claim 1, wherein the top h-track has a flange that is located between a top of the panel and a bottom of the top track.

6. The perimeter barrier of claim 1, wherein the bottom h-track has a flange that is located between a bottom of the panel and the j-track.

7. The perimeter barrier of claim 1, wherein each of the top and bottom h-tracks has slots that extend toward each other to define a space in which the door is located.

8. The perimeter barrier of claim 1, further comprising corner intersections and corners at each of the corner intersections of the perimeter barrier.

9. The perimeter barrier of claim 8, wherein each of the corners comprises a perpendicular section having sides, a wall extends from each of the sides of the perpendicular section, and a mounting flange extends from each of the walls, such that the mounting flanges are parallel to respective ones of the sides of the perpendicular section.

10. The perimeter barrier of claim 9, wherein each of the mounting flanges comprises a rounded edge.

11. The perimeter barrier of claim 1, further comprising an insulation panel.

12. The perimeter barrier of claim 11, wherein the insulation panel is installed behind an interior of the panel between the top track and the z-vent, and in the j-track, and the insulation panel comprises foam board.

13. The perimeter barrier of claim 12, wherein a bottom of the insulation panel is located between the panel and a bottom of the j-track, and a top of the insulation panel is located between the panel and the z-vent.

14. The perimeter barrier of claim 1, further comprising a bracket mounted to the building structure and to the top track and the z-vent.

15. The perimeter barrier of claim 1, wherein the door is not slidably mounted in the top and bottom h-tracks to move left or right relative thereto.

* * * * *